US011111457B2

(12) United States Patent
Iwai

(10) Patent No.: US 11,111,457 B2
(45) Date of Patent: Sep. 7, 2021

(54) LUBRICATING OIL COMPOSITION

(71) Applicant: IDEMITSU KOSAN CO., LTD., Chiyoda-ku (JP)

(72) Inventor: Toshiaki Iwai, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/806,432

(22) Filed: Mar. 2, 2020

(65) Prior Publication Data

US 2020/0199484 A1 Jun. 25, 2020

Related U.S. Application Data

(63) Continuation of application No. 16/076,376, filed as application No. PCT/JP2017/001754 on Jan. 19, 2017, now abandoned.

(30) Foreign Application Priority Data

Feb. 25, 2016 (JP) ..... 2016-034153

(51) Int. Cl.

| | |
|---|---|
| ***C10M 169/04*** | (2006.01) |
| ***C10M 137/08*** | (2006.01) |
| ***C10M 159/00*** | (2006.01) |
| ***C10M 133/06*** | (2006.01) |
| ***C10M 133/12*** | (2006.01) |
| ***C10M 141/10*** | (2006.01) |
| ***C10M 129/70*** | (2006.01) |
| *C10N 10/04* | (2006.01) |
| *C10N 30/04* | (2006.01) |
| *C10N 30/06* | (2006.01) |
| *C10N 30/00* | (2006.01) |
| *C10N 40/04* | (2006.01) |

(52) U.S. Cl.

CPC ..... *C10M 169/045* (2013.01); *C10M 129/70* (2013.01); *C10M 133/06* (2013.01); *C10M 133/12* (2013.01); *C10M 137/08* (2013.01); *C10M 141/10* (2013.01); *C10M 159/00* (2013.01); *C10M 2207/262* (2013.01); *C10M 2207/284* (2013.01); *C10M 2215/04* (2013.01); *C10M 2215/06* (2013.01); *C10M 2219/046* (2013.01); *C10M 2223/04* (2013.01); *C10M 2223/043* (2013.01); *C10M 2223/049* (2013.01); *C10N 2010/04* (2013.01); *C10N 2030/04* (2013.01); *C10N 2030/06* (2013.01); *C10N 2030/52* (2020.05); *C10N 2030/76* (2020.05); *C10N 2040/045* (2020.05)

(58) Field of Classification Search

CPC ..... C10M 169/045; C10M 129/70; C10M 137/08; C10M 159/00; C10M 133/06; C10M 133/12; C10M 2207/284; C10M 2215/04; C10M 2215/06; C10M 2223/043; C10M 2223/049; C10M 163/00; C10M 137/02; C10M 137/04; C10N 2210/02; C10N 2230/04; C10N 2230/06; C10N 2230/52; C10N 2230/76; C10N 2240/045

See application file for complete search history.

(56) References Cited

U.S. PATENT DOCUMENTS

| | | | | |
|---|---|---|---|---|
| 5,922,656 | A | 7/1999 | Yoshimura et al. | |
| 5,972,854 | A | 10/1999 | Ichihashi et al. | |
| 6,613,722 | B1 * | 9/2003 | Watts | C10M 141/10 508/195 |
| 2011/0053816 | A1 * | 3/2011 | Narita | C10M 141/10 508/408 |
| 2013/0184190 | A1 | 7/2013 | Tatsumi et al. | |
| 2014/0031268 | A1 * | 1/2014 | Sumiejski | C10M 141/12 508/191 |
| 2014/0378357 | A1 | 12/2014 | Narita et al. | |

FOREIGN PATENT DOCUMENTS

| | | | |
|---|---|---|---|
| EP | 0711822 | A2 | 5/1996 |
| EP | 2 246 412 | A1 | 11/2010 |
| GB | 2 164 352 | A | 3/1986 |
| JP | 10-265793 | A | 10/1998 |
| JP | 2001-513140 | A | 8/2001 |
| JP | 2009-167337 | A | 7/2009 |
| JP | 2014-98063 | A | 5/2014 |
| WO | WO 2013/137258 | A1 | 9/2013 |
| WO | WO 2015/141026 | A1 | 9/2015 |

OTHER PUBLICATIONS

International Search Report dated Feb. 14, 2017 in PCT/JP2017/001754 filed Jan. 19, 2017.

Extended European Search Report dated Sep. 24, 2019 in European Patent Application No. 17756034.9, 7 pages.

* cited by examiner

*Primary Examiner* — Taiwo Oladapo

(74) *Attorney, Agent, or Firm* — Oblon, McClelland, Maier & Neustadt, L.L.P.

(57) ABSTRACT

Disclosed is a lubricating oil composition capable of inhibiting vibrations or noises generated between a pulley and a chain or between a pulley and a belt in a CVT or the like, while increasing an intermetallic friction coefficient, the composition containing a base oil, an alkaline earth metal-based detergent (A), a phosphite ester (B1), a phosphate ester amine salt (B2), an acidic phosphate ester (B3), an aliphatic monoamine (C1), and an aromatic monoamine (C2).

8 Claims, No Drawings

LUBRICATING OIL COMPOSITION

CROSS REFERENCE TO RELATED APPLICATIONS

This application is a continuation application of prior U.S. application Ser. No. 16/076,376, filed Aug. 8, 2018, the disclosure of which is incorporated herein by reference in its entirety. U.S. application Ser. No. 16/076,376 is the national stage of PCT/JP2017/001754, filed Jan. 19, 2017, the disclosure of which is incorporated herein by reference in its entirety. U.S. application Ser. No. 16/076,376 claims priority to Japanese Application No. 2016-034153, filed Feb. 25, 2016, the disclosure of which is incorporated herein by reference in its entirety.

TECHNICAL FIELD

The present invention relates to a lubricating oil composition, and for example, it relates to a lubricating oil composition for continuously variable transmission.

BACKGROUND ART

Recently, in view of global environment issue, an improvement of fuel efficiency of an automobile is an important issue of concern. For this reason, a rate of automobiles equipped with a continuously variable transmission (CVT) which are more efficient than a multi-stage automatic transmission (AT) increases. As for the CVT, a belt-type CVT is generally used for engines with a relatively low torque, whereas a chain-type CVT is generally used for engines with a high torque.

In the belt-type or chain-type CVT, the power is transmitted via a friction between a pulley and a belt or between a pulley and a chain. In order to restrain a slippage therebetween, the belt or chain is pressed with a large force against the pulley. A lubricating oil is used for lubrication between the pulley and the belt or between the pulley and the chain. Reduction in a force of press results in improvement in fuel efficiency, and therefore, the lubricating oil for CVT is required to increase an intermetallic friction coefficient. In addition, vibrations or noises are often generated between the pulley and the belt or between the pulley and the chain.

Accordingly, in order to restrain the aforementioned vibrations or noises while increasing the intermetallic friction coefficient, lubricating oils for CVT obtained by blending an alkaline earth metal sulfonate with a high base number, a sulfur-containing phosphorus compound, and an aliphatic primary amine are known so far (see, for example, PTL 1).

CITATION LIST

Patent Literature

PTL 1: JP 2014-98063 A

SUMMARY OF INVENTION

Technical Problem

However, in recent years, a power of the engine becomes high and a torque or the like of the engine is also high, and therefore, in the CVT, particularly the chain-type CVT, the lubricating state between the pulley and the chain or belt has become severe. Accordingly, even if the conventional lubricating oil for CVT as disclosed in PTL 1 is used, the intermetallic friction coefficient cannot be occasionally thoroughly increased. Furthermore, it has become difficult to inhibit generation of the vibrations or noises between the pulley and the chain or between the pulley and the belt.

In view of the foregoing problems, the present invention has been made. A problem to be solved by the present invention is to provide a lubricating oil composition which can inhibit vibrations or noises generated between a pulley and a chain or between a pulley and a belt while increasing an intermetallic friction coefficient, even when the lubricating state in a CVT or the like becomes severe.

Solution to Problem

The present inventor made extensive and intensive investigations. As a result, it has been found that the foregoing problem can be solved by blending a base oil with specified phosphorus-based compound and amine-based compound, in addition to an alkaline earth metal-based detergent, thereby leading to accomplishment of the following inventions. Specifically, the present invention provides a lubricating oil composition and a method for producing a lubricating oil composition as mentioned below.

(1) A lubricating oil composition containing a base oil, an alkaline earth metal-based detergent (A), a phosphite ester (B1), a phosphate ester amine salt (B2), an acidic phosphate ester (B3), an aliphatic monoamine (C1), and an aromatic monoamine (C2).

(2) A method for producing a lubricating oil composition, including blending a base oil with at least an alkaline earth metal-based detergent (A), a phosphite ester (B1), a phosphate ester amine salt (B2), an acidic phosphate ester (B3), an aliphatic monoamine (C1), and an aromatic monoamine (C2), to obtain a lubricating oil composition.

Advantageous Effects of Invention

A lubricating oil composition which can inhibit vibrations or noises generated between a pulley and a chain or between a pulley and a belt while increasing an intermetallic friction coefficient, even when the lubricating state in a CVT or the like becomes severe, is provided.

DESCRIPTION OF EMBODIMENTS

The present invention is hereunder described by reference to embodiments.

The lubricating oil composition according to one embodiment of the present invention contains a base oil, an alkaline earth metal-based detergent (A), a phosphite ester (B1), a phosphate ester amine salt (B2), an acidic phosphate ester (B3), an aliphatic monoamine (C1), and an aromatic monoamine (C2). In the lubricating oil composition of the present embodiment, by jointly using the aforementioned three kinds of phosphorus-based compounds and the aforementioned two kinds of amine-based compounds, in addition to the alkaline earth metal-based detergent (A), it is possible to make an intermetallic friction coefficient high, even when the lubricating state becomes severe. In addition, intermetallic friction-coefficient/slipping-velocity characteristics (hereinafter also referred to as "intermetallic μ-V characteristics") becomes good. Therefore, it is also possible to reduce vibrations or noises generated between the pulley and the chain or between the pulley and the belt.

Each of the components that are used in the lubricating oil composition is hereunder described in detail.

<Base Oil>

The base oil which is used in the lubricating oil composition is not particularly limited, and all of mineral oils and synthetic oils which are usable for automatic transmissions can be used.

Examples of the mineral oil include a paraffinic mineral oil, an intermediate mineral oil, a naphthenic mineral oil, and the like, and specifically, a light neutral oil, a medium neutral oil, a heavy neutral oil, a bright stock, and the like. In addition, a GTL oil produced by isomerizing GTL WAX (gas to liquid wax), and so on are also exemplified as the mineral oil.

Examples of the synthetic oil include polyolefins represented by polybutene and an α-olefin homopolymer or copolymer (for example, an ethylene-α-olefin copolymer), various esters, such as a polyol ester, a dibasic acid ester, a phosphate ester, etc., various ethers, such as polyphenyl ether, a polyoxyalkylene glycol, etc., alkylbenzenes, alkylnaphthalenes, and the like.

In the lubricating oil composition, as the base oil, the aforementioned mineral oils may be used alone, or may be used in combination of two or more thereof. In addition, the aforementioned synthetic oils may be used alone, or may be used in combination of two or more thereof. Furthermore, a combination of one or more of the mineral oils and one or more of the synthetic oils may also be used.

Though the base oil is not particularly limited, its kinematic viscosity at 100° C. is preferably 0.5 to 10 $mm^2/s$, more preferably 1 to 7 $mm^2/s$, and still more preferably 1.5 to 4 $mm^2/s$. When the kinematic viscosity is the foregoing lower limit or more, the intermetallic friction coefficient readily becomes high. In addition, when the kinematic viscosity is the foregoing upper limit or less, the fuel-saving properties are improved.

A viscosity index of the base oil is preferably 80 or more, more preferably 90 or more, and still more preferably 100 or more. The kinematic viscosity and the viscosity index are those measured in conformity with JIS K2283:2000.

In the lubricating oil composition, the base oil is contained in an amount of preferably 60% by mass or more, more preferably 65 to 97% by mass, and still more preferably 70 to 95% by mass relative to the whole amount of the lubricating oil composition.

<Alkaline Earth Metal-Based Detergent (A)>

The lubricating oil composition of the present embodiment contains the alkaline earth metal-based detergent (A). In the present embodiment, by containing the alkaline earth metal-based detergent (A), not only the intermetallic friction coefficient can be increased, but also the intermetallic characteristics can be made good. Examples of the alkaline earth metal-based detergent (A) include an alkaline earth metal sulfonate, an alkaline earth metal salicylate, and an alkaline earth metal phenate. Here, examples of the alkaline earth metal include magnesium and calcium, and calcium is suitably used. Suitable specific examples of the alkaline earth metal-based detergent (A) include calcium sulfonate and calcium salicylate. The alkaline earth metal-based detergent (A) may be used alone, or may be used in combination of two or more thereof.

As the alkaline earth metal-based detergent (A), basic or overbased compounds are preferably used. A base number thereof is preferably 10 to 500 mgKOH/g. In addition, the base number is more preferably 200 to 500 mgKOH/g, and still more preferably 250 to 450 mgKOH/g. In this way, by making the base number of the alkaline earth metal-based detergent (A) high, the intermetallic friction coefficient is readily made higher. The total base number is one measured according to the perchloric acid method of JIS K-2501.

The amount of the alkaline earth metal atom derived from the alkaline earth metal-based detergent (A) is preferably 10 to 1,500 ppm by mass, more preferably 150 to 1,000 ppm by mass, and still more preferably 250 to 750 ppm by mass on the basis of the whole amount of the lubricating oil composition. By containing the component (A) in the lubricating oil composition such that the metal amount falls within the aforementioned range, the intermetallic friction coefficient is readily made higher.

The amount of the alkaline earth metal atom is one obtained by measuring the amount of alkaline earth metal atom of the component (A) through ICP analysis and expressing it on the basis of the whole amount of the composition.

(Phosphorus-Based Compound)

The lubricating oil composition contains, as the phosphorus-based compound, three kinds of the phosphite ester (B1), the phosphate ester amine salt (B2), and the acidic phosphate ester (B3). When the lubricating oil composition contains these three kinds of phosphorus-based compounds, even in the case where the lubricating state becomes severe as mentioned above, it is easy to make the intermetallic μ-V characteristics good while making the intermetallic friction coefficient high.

<Phosphite Ester (B1)>

Specifically, examples of the phosphite ester (B1) include a compound represented by the following formula (I).

$$(R^1O)_aP(OH)_{3-a} \quad (I)$$

In the formula (I), $R^1$ represents a hydrocarbon group having 2 to 24 carbon atoms; a represents an integer of 1 to 3; and when a is 2 or 3, $R^1$'s may be the same as or different from each other.

In the formula (I), examples of the hydrocarbon group having 2 to 24 carbon atoms as represented by $R^1$ include an alkyl group having 2 to 24 carbon atoms, an alkenyl group having 2 to 24 carbon atoms, an aryl group having 6 to 24 carbon atoms, an aralkyl group having 7 to 24 carbon atoms, and the like.

The alkyl group and the alkenyl group may be each any of straight-chain, branched, and cyclic groups. Examples thereof include an ethyl group, a n-propyl group, an isopropyl group, a n-butyl group, an isobutyl group, a sec-butyl group, a tert-butyl group, a pentyl group of every kind, a hexyl group of every kind, an octyl group of every kind, a decyl group of every kind, a dodecyl group of every kind, a tetradecyl group of every kind, a hexadecyl group of every kind, an octadecyl group of every kind, a nonadecyl group of every kind, an eicosyl group of every kind, a heneicosyl group of every kind, a docosyl group of every kind, a tricosyl group of every kind, a tetracosyl group of every kind, a cyclopentyl group, a cyclohexyl group, an allyl group, a propenyl group, a butenyl group of every kind, a hexenyl group of every kind, an octenyl group of every kind, a decenyl group of every kind, a dodecenyl group of every kind, a tetradecenyl group of every kind, a hexadecenyl group of every kind, an octadecenyl group of every kind, a nonadecenyl group of every kind, an eicosenyl group of every kind, a heneicosenyl group of every kind, a docosenyl group of every kind, a tricosenyl group of every kind, a tetracosenyl group of every kind, a cyclopentenyl group, a cyclohexenyl group, and the like. The wording "every kind" is meant to include a straight-chain group and all other branched groups of structural isomers thereof, and the same is hereunder applicable.

Examples of the aryl group having 6 to 24 carbon atoms include a phenyl group, a tolyl group, a xylyl group, a naphthyl group, and the like, and examples of the aralkyl group having 7 to 24 carbon atoms include a benzyl group, a phenethyl group, a naphthylmethyl group, a methylbenzyl group, a methylphenethyl group, a methylnaphthylmethyl group, and the like.

The phosphite ester (B1) is preferably one represented by the formula (I) in which a is 2 and $R^1$ is an aliphatic hydrocarbon group having 8 to 20 carbon atoms, more preferably one represented by the formula (I) in which a is 2 and $R^1$ is an aliphatic hydrocarbon group having 10 to 18 carbon atoms, and more preferably one represented by the formula (I) in which a is 2 and $R^1$ is an alkyl group having 10 to 18 carbon atoms.

Examples of the phosphite ester (B1) include didecyl hydrogen phosphite, dilauryl hydrogen phosphite, dimyristyl hydrogen phosphite, dipalmityl hydrogen phosphite, distearyl hydrogen phosphite, and the like. Above all, dilauryl hydrogen phosphite is preferred.

The phosphite ester (B1) may be used alone, or may be used in combination of two or more thereof.

The content of the phosphite ester (B1) in the lubricating oil composition is preferably 0.01 to 0.5% by mass, more preferably 0.02 to 0.3% by mass, and still more preferably 0.03 to 0.2% by mass on the basis of the whole amount of the lubricating oil composition.

<Phosphate Ester Amine Salt (B2)>

Specifically, examples of the phosphate ester amine salt (B2) include an amine salt of an acidic phosphate ester represented by the following formula (II).

$$(R^2O)_bP(=O)(OH)_{3-b} \quad \text{(II)}$$

In the formula (II), $R^2$ represents a hydrocarbon group having 2 to 24 carbon atoms; b represents an integer of 1 or 2; and when b is 2, $R^2$'s may be the same as or different from each other.

In the formula (II), examples of the hydrocarbon group having 2 to 24 carbon atoms as represented by $R^2$ include an alkyl group having 2 to 24 carbon atoms, an alkenyl group having 2 to 24 carbon atoms, an aryl group having 6 to 24 carbon atoms, an aralkyl group having 7 to 24 carbon atoms, and the like.

Here, the alkyl group and the alkenyl group may be each any of straight-chain, branched, and cyclic groups. In addition, as examples of the alkyl group, the alkenyl group, the aryl group, and the aralkyl group represented by $R^2$, the same groups as enumerated above for $R^1$ are exemplified.

The phosphate ester which is used for the phosphate ester amine salt (B2) is preferably one represented by the formula (II) in which $R^2$ is an aliphatic hydrocarbon group having 8 to 20 carbon atoms, more preferably one represented by the formula (II) in which $R^2$ is an aliphatic hydrocarbon group having 12 to 18 carbon atoms, and still more preferably one represented by the formula (II) in which $R^2$ is an alkenyl group having 12 to 18 carbon atoms.

Specifically, examples of the phosphate ester which is used for the phosphate ester amine salt (B2) include monolauryl acid phosphate, monomyristyl acid phosphate, monopalmityl acid phosphate, monostearyl acid phosphate, monooleyl acid phosphate, dilauryl acid phosphate, dimyristyl acid phosphate, dipalmityl acid phosphate, distearyl acid phosphate, dioleyl acid phosphate, and the like. Of these, monooleyl acid phosphate, dioleyl acid phosphate, or a mixture thereof is preferred.

The phosphate ester which is used for the phosphate ester amine salt (B2) may be used alone, or may be used in combination of two or more thereof.

The amine for forming the phosphate ester amine salt may be any of a primary amine, a secondary amine, and a tertiary amine. In addition, examples of the foregoing amine include an amine represented by the general formula: $NR_3$, in which 1 to 3 of Rs are an aliphatic hydrocarbon group, with the remainder being a hydrogen atom. Here, the aliphatic hydrocarbon group is preferably an alkyl group or an unsaturated hydrocarbon group having 1 to 2 unsaturated double bonds, and the alkyl group and the unsaturated hydrocarbon group may be each any of straight-chain, branched, and cyclic groups. The aforementioned aliphatic hydrocarbon group is preferably one having 6 to 20 carbon atoms, and more preferably one having 12 to 20 carbon atoms. The amine is still more preferably a primary amine in which the aliphatic hydrocarbon group has 12 to 20 carbon atoms, and examples thereof include oleylamine.

The amine may be used alone, or may be used in combination of two or more thereof.

The content of the phosphate ester amine salt (B2) in the lubricating oil composition is preferably 0.01 to 0.5% by mass, more preferably 0.02 to 0.3% by mass, and still more preferably 0.03 to 0.2% by mass on the basis of the whole amount of the lubricating oil composition.

<Acidic Phosphate Ester (B3)>

Specifically, examples of the acidic phosphate ester (B3) include a compound represented by the following formula (III).

$$(R^3O)_cP(=O)(OH)_{3-c} \quad \text{(III)}$$

In the formula (III), $R^3$ represents a hydrocarbon group having 2 to 24 carbon atoms; c represents an integer of 1 or 2; and when c is 2, $R^3$'s may be the same as or different from each other.

In the formula (III), examples of the hydrocarbon group having 2 to 24 carbon atoms as represented by $R^3$ include an alkyl group having 2 to 24 carbon atoms, an alkenyl group having 2 to 24 carbon atoms, an aryl group having 6 to 24 carbon atoms, an aralkyl group having 7 to 24 carbon atoms, and the like.

Here, the alkyl group and the alkenyl group may be each any of straight-chain, branched, and cyclic groups. In addition, as examples of the alkyl group, the alkenyl group, the aryl group, and the aralkyl group represented by $R^3$, the same groups as enumerated above for $R^1$ are exemplified.

The acidic phosphate ester (B3) is preferably one represented by the formula (III) in which $R^3$ is an aliphatic hydrocarbon group having 8 to 20 carbon atoms, more preferably one represented by the formula (III) in which $R^3$ is an aliphatic hydrocarbon group having 12 to 18 carbon atoms, and still more preferably one represented by the formula (III) in which $R^3$ is an alkenyl group having 12 to 18 carbon atoms.

Specifically, examples of the acidic phosphate ester (B3) include monolauryl acid phosphate, monomyristyl acid phosphate, monopalmityl acid phosphate, monostearyl acid phosphate, monooleyl acid phosphate, dilauryl acid phosphate, dimyristyl acid phosphate, dipalmityl acid phosphate, distearyl acid phosphate, dioleyl acid phosphate, and the like. Of these, monooleyl acid phosphate, dioleyl acid phosphate, or a mixture thereof is preferred.

The acidic phosphate ester (B3) may be used alone, or may be used in combination of two or more thereof.

The content of the acidic phosphate ester (B3) in the lubricating oil composition is preferably 0.01 to 0.8% by mass, more preferably 0.02 to 0.5% by mass, and still more preferably 0.03 to 0.3% by mass on the basis of the whole amount of the lubricating oil composition.

In the lubricating oil composition of the present embodiment, a sum total of the amounts of the phosphorus atom derived from the aforementioned components (B1) to (B3) is preferably 10 to 1,000 ppm by mass, more preferably 30 to 500 ppm by mass, and still more preferably 60 to 190 ppm by mass on the basis of the whole amount of the lubricating oil composition. When the phosphorus amount derived from the components (B1) to (B3) falls within the foregoing range, it becomes easy to make both the high metal friction coefficient and the good intermetallic μ-V characteristics compatible with each other.

The content of the phosphorus atom derived from the components (B1) to (B3) is one obtained by measuring the phosphorus amount of each of the components (B1) to (B3) through ICP analysis and expressing it on the basis of the whole amount of the composition, and the sum total of the amount of the phosphorus atom means a total amount thereof.

(Amine-Based Compound)

The lubricating oil composition in the present embodiment contains, as the amine-based compound, the aliphatic monoamine (C1) and the aromatic monoamine (C2). When the lubricating oil composition of the present embodiment contains these two kinds of amine-based compounds, even in the case where the lubricating state becomes severe, it is easy to make the intermetallic μ-V characteristics good.

<Aliphatic Monoamine (C1)>

Specifically, examples of the aliphatic monoamine (C1) include a compound represented by the following formula (IV).

$$NR^4R^5R^6 \quad \text{(IV)}$$

In the formula (IV), $R^4$ represents an aliphatic hydrocarbon group having 10 to 24 carbon atoms; $R^5$ and $R^6$ each represent a hydrogen atom or an alkyl group having 1 to 4 carbon atoms; and $R^5$ and $R^6$ may be the same as or different from each other.

In the formula (IV), examples of the aliphatic hydrocarbon group having 10 to 24 carbon atoms as represented by $R^4$ include an alkyl group having 10 to 24 carbon atoms, an alkenyl group having 10 to 24 carbon atoms, and the like.

The alkyl group and the alkenyl group may be each any of straight-chain, branched, and cyclic groups. Examples thereof include a decyl group of every kind, a dodecyl group of every kind, a tetradecyl group of every kind, a hexadecyl group of every kind, an octadecyl group of every kind, a nonadecyl group of every kind, an eicosyl group of every kind, a heneicosyl group of every kind, a docosyl group of every kind, a tricosyl group of every kind, a tetracosyl group of every kind, a decenyl group of every kind, a dodecenyl group of every kind, a tetradecenyl group of every kind, a hexadecenyl group of every kind, an octadecenyl group of every kind, a nonadecenyl group of every kind, an eicosenyl group of every kind, a heneicosenyl group of every kind, a docosenyl group of every kind, a tricosenyl group of every kind, a tetracosenyl group of every kind, and the like.

In the formula (IV), examples of the alkyl group having 1 to 4 carbon atoms as represented by $R^5$ and $R^6$ include a methyl group, an ethyl group, a n-propyl group, an isopropyl group, a n-butyl group, an isobutyl group, a sec-butyl group, and a tert-butyl group.

The aliphatic monoamine (C1) is preferably an aliphatic monoamine represented by the formula (IV) in which $R^4$ is an aliphatic hydrocarbon group having 12 to 18 carbon atoms, and $R^5$ and $R^6$ are each a hydrogen atom or an alkyl group having 1 to 2 carbon atoms. Above all, the aliphatic monoamine (C1) is more preferably a primary amine represented by the formula (IV) in which $R^4$ is an aliphatic hydrocarbon group having 12 to 18 carbon atoms and $R^5$ and $R^6$ are each a hydrogen atom, and still more preferably a primary amine represented by the formula (IV) in which $R^4$ is an alkenyl group having 12 to 18 carbon atoms and $R^5$ and $R^6$ are each a hydrogen atom.

The aliphatic monoamine (C1) may be used alone, or may be used in combination of two or more thereof.

As mentioned above, the aliphatic monoamine (C1) is preferably a primary amine, and as the component (C1), though a primary amine (namely, an amine represented by the formula (IV) in which $R^5$ and $R^6$ are each a hydrogen atom) may be used alone, a primary amine and a tertiary amine (namely, an amine represented by the formula (IV) in which $R^5$ and $R^6$ are each an alkyl group) may also be jointly used.

In the case of joint use, it is preferred that not only the primary amine is one represented by the formula (IV) in which $R^4$ is an aliphatic hydrocarbon group having 12 to 18 carbon atoms, and $R^5$ and $R^6$ are each a hydrogen atom as mentioned above, but also the tertiary amine is one represented by the formula (IV) in which $R^4$ is an aliphatic hydrocarbon group having 12 to 18 carbon atoms, and $R^5$ and $R^6$ are each an alkyl group having 1 to 2 carbon atoms.

In the case of jointly using the primary amine and the tertiary amine, a ratio of the mass of the tertiary amine expressed in terms of a nitrogen atom to the mass of the primary amine expressed in terms of a nitrogen atom {(tertiary amine)/(primary amine)} is preferably 0.15 to 6, preferably 0.25 to 4, and still more preferably 0.33 to 3.

Suitable specific examples of the primary amine which is usable as the aliphatic monoamine (C1) include laurylamine, myristylamine, palmitylamine, stearylamine, and oleylamine. Above all, oleylamine is especially preferred. In addition, examples of the tertiary amine include dimethyllaurylamine, dimethylmyristylamine, dimethylpalmitylamine, dimethylstearylamine, dimethyloleylamine, and the like. Above all, dimethylstearylamine is especially preferred.

The content of the aliphatic monoamine (C1) in the lubricating oil composition is preferably 0.01 to 0.8% by mass, more preferably 0.02 to 0.6% by mass, and still more preferably 0.03 to 0.4% by mass on the basis of the whole amount of the lubricating oil composition.

<Aromatic Monoamine (C2)>

Specifically, examples of the aromatic monoamine (C2) include a compound represented by the following formula (V).

$$NR^7R^8R^9 \quad \text{(V)}$$

In the formula (V), $R^7$ represents an aromatic hydrocarbon group having 6 to 12 carbon atoms; $R^8$ and $R^9$ each represent a hydrogen atom or an alkyl group having 1 to 4 carbon atoms; and $R^8$ and $R^9$ may be the same as or different from each other.

In the formula (V), examples of the aromatic hydrocarbon group having 6 to 12 carbon atoms as represented by $R^7$ include an aryl group having 6 to 12 carbon atoms, an aralkyl group having 7 to 12 carbon atoms, and the like.

Examples of the aryl group having 6 to 12 carbon atoms include a phenyl group, a tolyl group, a xylyl group, a naphthyl group, and the like, and examples of the aralkyl group having 7 to 12 carbon atoms include a benzyl group, a phenethyl group, a naphthylmethyl group, a methylbenzyl group, a methylphenethyl group, a methylnaphthylmethyl group, and the like.

Examples of the alkyl group having 1 to 4 carbon atoms as represented by $R^8$ and $R^9$ include a methyl group, an ethyl group, a n-propyl group, an isopropyl group, a n-butyl group, an isobutyl group, a sec-butyl group, and a tert-butyl group.

The aromatic monoamine (C2) may be used alone, or may be used in combination of two or more thereof.

The aromatic monoamine (C2) is preferably one represented by the formula (V) in which all of $R^8$ and $R^9$ are a hydrogen atom, and specifically, the aromatic monoamine (C2) is more preferably phenylamine.

The content of the aromatic monoamine (C2) in the lubricating oil composition is preferably 0.01 to 1% by mass, more preferably 0.05 to 0.7% by mass, and still more preferably 0.1 to 0.5% by mass on the basis of the whole amount of the lubricating oil composition.

In the lubricating oil composition, a sum total of the amounts of the nitrogen atom derived from the components (C1) to (C2) is preferably 100 to 3,000 ppm by mass, more preferably 125 to 1,000 ppm by mass, and still more preferably 150 to 600 ppm by mass on the basis of the whole amount of the lubricating oil composition.

When the sum total of the nitrogen atom falls within the foregoing range, it becomes easy to obtain good intermetallic μ-V characteristics even under severe conditions.

The amount of the nitrogen atom derived from the components (C1) to (C2) is one obtained by measuring the amount of the nitrogen atom of each of the components (C1) to (C2) in conformity with JIS K2609:1998 and expressing it on the basis of the whole amount of the composition, and the sum total of the amounts of the nitrogen atom means a total amount thereof.

In the present embodiment, more suitable examples of the lubricating oil composition include one containing a base oil; at least one component (A) selected from the group consisting of calcium sulfonate and calcium salicylate; the component (B1) represented by the formula (I), in which a is 2, and $R^1$ is an aliphatic hydrocarbon group having 10 to 18 carbon atoms; the component (B2) that is an amine salt of a phosphate ester represented by the formula (II), in which $R^2$ is an aliphatic hydrocarbon group having 12 to 18 carbon atoms; the component (B3) represented by the formula (III), in which $R^3$ is an aliphatic hydrocarbon group having 12 to 18 carbon atoms; the component (C1) containing a primary amine represented by the formula (IV), in which $R^4$ is an aliphatic hydrocarbon group having 12 to 18 carbon atoms, and $R^5$ and $R^6$ are each a hydrogen atom; and the component (C2) represented by the formula (V), in which $R^7$ is an aromatic hydrocarbon group having 6 to 12 carbon atoms, and all of $R^8$ and $R^9$ are a hydrogen atom.

Most suitable examples of the lubricating oil composition include one containing a base oil; at least one selected from the group consisting of calcium sulfonate and calcium salicylate; dilauryl hydrogen phosphite; an amine salt of at least one phosphate ester selected from the group consisting of dioleyl acid phosphate and monooleyl acid phosphate; at least one selected from the group consisting of dioleyl acid phosphate and monooleyl acid phosphate; oleylamine; oleylamine; and phenylamine.

(Other Additives)

The lubricating oil composition may contain other additives, in addition to the aforementioned component (A), components (B1) to (B3), and components (C1) and (C2), as required, within a range where the effects of the present invention are not impaired. Examples of the other additive include an antioxidant, a viscosity index improver, an ashless dispersant, a sulfur-based extreme pressure agent, a copper deactivator, a rust inhibitor, a friction modifier, an anti-foaming agent, and the like. These other additives may be properly chosen and used either alone or in combination of two or more thereof.

That is, the lubricating oil composition may be composed of the aforementioned component (A), components (B1) to (B3), and components (C1) and (C2), or may be composed of the aforementioned component (A), components (B1) to (B3), and components (C1) and (C2), and other additives.

Examples of the antioxidant include an amine-based antioxidant other than the aforementioned component (C1) and (C2) (for example, a diphenylamine compound, a phenylnaphthylamine compound, etc.), a phenol-based antioxidant, a sulfur-based antioxidant, and the like. The content of the antioxidant is preferably 0.05 to 7% by mass, and more preferably 0.1 to 5% by mass on the basis of the whole amount of the lubricating oil composition.

Examples of the viscosity index improver include a polymethacrylate, a dispersant-type polymethacrylate, an olefinic copolymer, such as an ethylene-propylene copolymer, etc., a dispersant-type olefinic copolymer, a styrene-based copolymer, such as a styrene-diene copolymer, a styrene-isoprene copolymer, etc., and the like. In order to appropriately improve the viscosity index, the content of the viscosity index improver is preferably 0.5 to 20% by mass, and more preferably 1 to 15% by mass on the basis of the whole amount of the composition.

Examples of the ashless dispersant include a succinimide compound, a boron-based imide compound, an acid amide-based compound, and the like. The content of the ashless dispersant is preferably 0.1 to 20% by mass, and more preferably 0.5 to 15% by mass on the basis of the whole amount of the composition.

Examples of the sulfur-based extreme pressure agent include a thiadiazole-based compound, a polysulfide-based compound, a thiocarbamate-based compound, a sulfurized oils and fats-based compound, a sulfurized olefin-based compound, and the like. The content of the sulfur-based extreme pressure agent is preferably 0.02 to 3% by mass, and more preferably 0.05 to 2% by mass on the basis of the whole amount of the lubricating oil composition.

Examples of the copper deactivator include benzotriazole, a benzotriazole derivative, triazole, a triazole derivative, imidazole, an imidazole derivative, thiadiazole, a thiadiazole derivative, and the like. The content of the copper deactivator is preferably 0.01 to 5% by mass, and more preferably 0.02 to 3% by mass on the basis of the whole amount of the lubricating oil composition.

Examples of the rust inhibitor include a fatty acid, an alkenyl succinic acid half ester, a fatty acid soap, an alkyl sulfonate salt, a polyhydric alcohol fatty acid ester, a fatty acid amide, an oxidized paraffin, an alkyl polyoxyethylene ether, and the like. The content of the rust inhibitor is preferably 0.01 to 3% by mass, and more preferably 0.02 to 2% by mass on the basis of the whole amount of the lubricating oil composition.

Examples of the friction modifier include a carboxylic acid, a carboxylic acid ester, oils and fats, a carboxylic acid amide, a sarcosine derivative, and the like. The content of the friction modifier is preferably 0.01 to 5% by mass, and more preferably 0.05 to 3% by mass on the basis of the whole amount of the lubricating oil composition.

Examples of the anti-foaming agent include a silicone-based compound, a fluorosilicone-based compound, an ester-based compound, and the like. The content of the anti-foaming agent is preferably 0.01 to 5% by mass, and more preferably 0.01 to 0.5% by mass on the basis of the whole amount of the lubricating oil composition.

(Production Method of Lubricating Oil Composition)

The method for producing a lubricating oil composition according to one embodiment of the present invention is a method including blending a base oil with at least an alkaline earth metal-based detergent (A), a phosphite ester (B1), a phosphate ester amine salt (B2), an acidic phosphate ester (B3), an aliphatic monoamine (C1), and an aromatic monoamine (C2), to obtain a lubricating oil composition. In the present method, the base oil may be further blended with other additives than the components (A), (B1) to (B3), (C1), and (C2). Details of each of the components are those mentioned above, and therefore, descriptions thereof are omitted.

(Application of Lubricating Oil Composition)

Though the lubricating oil composition of the present embodiment is used for a manual transmission, a multi-stage automatic transmission (AT), and a continuously variable transmission (CVT), and so on, it is suitably used for an automatic transmission, especially a CVT. Specific example of the CVT include a chain-type CVT and a belt-type CVT. Above all, the lubricating oil composition of the present embodiment is especially suitable for a chain-type CVT. The lubricating oil composition is used for lubrication between a pulley and a chain or between a pulley and a belt in the chain-type CVT or belt-type CVT.

EXAMPLES

The present invention is hereunder more specifically described by reference to Examples, but is should be construed that the present invention is by no means limited by these Examples.

The evaluation methods in the present invention are as follows.

(1) Intermetallic Friction Coefficient:

The intermetallic friction coefficient was evaluated using a block-on-ring tester (manufactured by Falex Corporation) in conformity with ASTM D2714. As the intermetallic friction coefficient is higher, the transmission torque capacity also becomes larger. The evaluation conditions are as follows.

<Breaking-In Conditions>

Surface pressure: 0.8 GPa
Oil temperature: 90° C.
Average slipping velocity: 0.500 m/s
Time: 30 minutes <Measurement Conditions>

Surface pressure: 0.8 GPa
Oil temperature: 90° C.
Average slipping velocity: 0.500 m/s <Material of Test Piece>

Steel-steel (2) Intermetallic μ-V Characteristics (μ ratio)

The μ ratio was determined and evaluated using a block-on-ring tester (manufactured by Falex Corporation) in conformity with ASTM D2714. As the μ ratio is smaller value, vibrations or noises are hardly generated. The evaluation conditions are as follows.

<Breaking-In Conditions>

Surface pressure: 0.8 GPa
Oil temperature: 90° C.
Average slipping velocity: 0.500 m/s
Time: 30 minutes <Measurement Conditions>

Surface pressure: 0.8 GPa
Oil temperature: 90° C.
Average slipping velocity: 0.025 m/s and 0.500 m/s <Material of Test Piece>

Steel-steel

<Calculation Method of μ Ratio>

μ Ratio=(Friction coefficient at 0.025 m/s)/(Friction coefficient at 0.500 m/s)

Examples 1 to 3 and Comparative Examples 1 to 8

A lubricating oil composition of each of Examples 1 to 3 and Comparative Examples 1 to 8 was prepared according to a blend shown in Table 1. Each of the components used in the Examples and Comparative Examples are as follows.

Base oil: 70N mineral oil (kinematic viscosity at 100° C.: 2.8 $mm^2/s$, viscosity index: 100)

(Alkaline Earth Metal-Based Detergent)

Calcium sulfonate (A): Calcium sulfonate having a base number of 400 mgKOH/g

Calcium salicylate (A): Calcium salicylate having a base number of 300 mgKOH/g (Phosphorus-Based Compound)

Phosphite ester (B1): Dilauryl hydrogen phosphite

Phosphate ester amine salt (B2): Amine salt of a mixture of monooleyl acid phosphate and dioleyl acid phosphate; using oleylamine as the amine Acidic phosphate ester (B3): Mixture of monooleyl acid phosphate and dioleyl acid phosphate (Amine-Based Compound)

Aliphatic monoamine 1 (C1): Oleylamine

Aromatic monoamine (C2): Phenylamine

Aliphatic monoamine 2 (tertiary amine) (C1): Dimethylstearylamine

Aliphatic monoamine 3 (C1): Octylamine

Other additives: Polymethacrylate, imide compound, and amide compound

TABLE 1

| | | Example | | | Comparative Example | | |
|---|---|---|---|---|---|---|---|
| | | 1 | 2 | 3 | 1 | 2 | 3 |
| Blend composition (% by mass) | Base oil | 77 | 77 | 77 | 77 | 77 | 77 |
| | Alkaline earth metal-based deterqent | | | | | | |
| | Calcium sulfonate (component (A)) | 0.40 | 0.40 | | | 0.40 | 0.40 |
| | Calcium salicylate (component (A)) | | | 0.50 | | | |
| | Phosohorus-based compound | | | | | | |
| | Phosphite ester (component (B1)) | 0.05 | 0.05 | 0.05 | 0.05 | | 0.05 |
| | Phosphate ester amine salt (component (B2)) | 0.05 | 0.05 | 0.50 | 0.05 | 0.05 | |
| | Acidic phosphate ester (component (B3)) | 0.10 | 0.10 | 0.10 | 0.10 | 0.10 | 0.10 |
| | Amine-based compound | | | | | | |

TABLE 1-continued

| | | | | | | | |
|---|---|---|---|---|---|---|---|
| | Aliphatic monoamine 1 (component (C1)) | 0.05 | 0.05 | 0.05 | 0.05 | 0.05 | 0.05 |
| | Aromatic monoamine (component (C2)) | 0.30 | 0.30 | 0.30 | 0.30 | 0.30 | 0.30 |
| | Aliphatic amine 2 (tertiary amine) (component (C1)) | | 0.10 | | | | |
| | Aliphatic monoamine 3 (component (C1)) | | | | | | |
| | Other additives | 22.05 | 21.95 | 21.95 | 22.45 | 22.10 | 22.10 |
| | Total | 100.00 | 100.00 | 100.00 | 100.00 | 100.00 | 100.00 |
| Amount of atom (ppm by mass) | Amount of alkaline earth metal (Ca) of component (A) | 500 | 500 | 500 | 0 | 500 | 500 |
| | Total amount of phosphorus of components (B1) to (B3) | 120 | 120 | 120 | 120 | 100 | 80 |
| | Total amount of nitrogen of components (C1) to (C2) | 200 | 250 | 200 | 200 | 200 | 200 |
| Evaluation results | LFW-1 Intermetallic friction coefficient (0.500 m/s) | 0.115 | 0.114 | 0.114 | 0.098 | 0.111 | 0.111 |
| | μ ratio (0.025 m/s/0.500 m/s) | 1.03 | 1.02 | 1.03 | 1.18 | 1.05 | 1.07 |

| | | Comparative Example | | | | |
|---|---|---|---|---|---|---|
| | | 4 | 5 | 6 | 7 | 8 |
| Blend composition (% by mass) | Base oil | 77 | 77 | 77 | 76.2 | 72 |
| | Alkaline earth metal-based deterqent | | | | | |
| | Calcium sulfonate (component (A)) | 0.40 | 0.40 | 0.40 | 0.30 | 0.40 |
| | Calcium salicylate (component (A)) | | | | | |
| | Phosohorus-based compound | | | | | |
| | Phosphite ester (component (B1)) | 0.05 | 0.05 | 0.05 | | 0.05 |
| | Phosphate ester amine salt (component (B2)) | 0.05 | 0.05 | 0.05 | | |
| | Acidic phosphate ester (component (B3)) | | 0.10 | 0.10 | | |
| | Amine-based compound | | | | | |
| | Aliphatic monoamine 1 (component (C1)) | 0.05 | | 0.05 | | 0.05 |
| | Aromatic monoamine (component (C2)) | 0.30 | 0.30 | | | 0.30 |
| | Aliphatic amine 2 (tertiary amine) (component (C1)) | | | | | |
| | Aliphatic monoamine 3 (component (C1)) | | | | 0.40 | |
| | Other additives | 22.15 | 22.10 | 22.35 | 23.10 | 22.20 |
| | Total | 100.00 | 100.00 | 100.00 | 100.00 | 100.00 |
| Amount of atom (ppm by mass) | Amount of alkaline earth metal (Ca) of component (A) | 500 | 500 | 500 | 360 | 500 |
| | Total amount of phosphorus of components (B1) to (B3) | 60 | 120 | 120 | 0 | 20 |
| | Total amount of nitrogen of components (C1) to (C2) | 200 | 100 | 100 | 380 | 200 |
| Evaluation results | LFW-1 Intermetallic friction coefficient (0.500 m/s) | 0.111 | 0.112 | 0.111 | 0.110 | 0.109 |
| | μ ratio (0.025 m/s/0.500 m/s) | 1.07 | 1.08 | 1.07 | 1.06 | 1.07 |

In the light of the above, in the lubricating oil compositions of Examples 1 to 3, by containing the components (B1) to (B3) as the phosphorus-based compound and the components (C1) and (C2) as the amine-based compound in addition to the alkaline earth metal-based detergent (A), the intermetallic friction coefficient could be increased to a high value even under conditions at which the slipping velocity is fast, and the lubricating state is severe. In addition, in view of the fact that the intermetallic μ-V characteristics became good, the vibrations and noises can be reduced, too.

On the other hand, in the lubricating oil compositions of Comparative Examples 1 to 8, in view of the fact that any one of the component (A), the components (B1) to (B3), and the components (C1) and (C2) is not contained, the intermetallic friction coefficient became a low value, and furthermore, the intermetallic μ-V characteristics did not become good.

The invention claimed is:

1. A method to lubricate a continuously variable transmission (CVT), comprising:

applying a lubricating oil composition between a pulley and a belt or between a pulley and a chain of the CVT;

wherein the lubricating oil composition comprises:

a base oil;

(A) an alkaline earth metal-based detergent (A) having a base number of from 10 to 500 mgKOH/g as measured according to the perchloric acid method of JIS K-2501, wherein the amount of the alkaline earth metal atom derived from the alkaline earth metal-based detergent (A) is from 10 to 1,500 ppm by mass;

(B1) 0.01 to 0.5% by mass of a phosphite ester (B1) represented by the following formula (I):

$$(R^1O)_aP(OH)_{3-a} \quad (I)$$

wherein $R^1$ represents a hydrocarbon group having 2 to 24 carbon atoms; a represents an integer of 1 to 3; and when a is 2 or 3, $R^1$'s may be the same as or different from each other, (B2) 0.01 to 0.5% by mass of a phosphate ester amine salt (B2) which is an amine salt of an acidic phosphate ester represented by the following formula (II):

$$(R^2O)_bP(=O)(OH)_{3-b} \quad \text{(II)}$$

wherein $R^2$ represents a hydrocarbon group having 2 to 24 carbon atoms; b represents an integer of 1 or 2; and when b is 2, $R^2$'s may be the same as or different from each other, (B3) 0.01 to 0.8% by mass of an acidic phosphate ester (B3) represented by the following formula (III):

$$(R^3O)_cP(=O)(OH)_{3-c} \quad \text{(III)}$$

wherein $R^3$ represents a hydrocarbon group having 2 to 24 carbon atoms; c represents an integer of 1 or 2; and when c is 2, $R^3$'s may be the same as or different from each other, (C1) 0.01 to 0.8% by mass of an aliphatic monoamine (C1) represented by the following formula (IV):

$$NR^4R^5R^6 \quad \text{(IV)}$$

wherein $R^4$ represents an aliphatic hydrocarbon group having 10 to 24 carbon atoms; $R^5$ and $R^6$ each represent a hydrogen atom or an alkyl group having 1 to 4 carbon atoms; and $R^5$ and $R^6$ may be the same as or different from each other, and (C2) 0.05 to 0.7% by mass of an aromatic monoamine (C2) represented by the following formula (V):

$$NR^7R^8R^9 \quad \text{(V)}$$

wherein $R^7$ represents an aromatic hydrocarbon group having 6 to 12 carbon atoms; $R^8$ and $R^9$ each represent a hydrogen atom or an alkyl group having 1 to 4 carbon atoms; and $R^8$ and $R^9$ may be the same as or different from each other; and further wherein an intermetallic friction coefficient according to ASTM D2714 of the lubricating oil is 0.114 or more, wherein the test is run under the following conditions:

<Breaking-in conditions>
Surface pressure: 0.8 GPa
Oil temperature: 90° C.
Average slipping velocity: 0.500 m/s
Time: 30 minutes <Measurement conditions>
Surface pressure: 0.8 GPa
Oil temperature: 90° C.
Average slipping velocity: 0.500 m/s <Material of test piece>
Steel-steel;
and a ratio of intermetallic friction-coefficient/slipping-velocity according to ASTM D2714 of the lubricating oil is 1.03 or less wherein the test is run under the following conditions:

<Breaking-in conditions>
Surface pressure: 0.8 GPa
Oil temperature: 90° C.
Average slipping velocity: 0.500 m/s
Time: 30 minutes <Measurement conditions>
Surface pressure: 0.8 GPa
Oil temperature: 90° C.
Average slipping velocity: 0.025 m/s and 0.500 m/s <Material of test piece>
Steel-steel <Calculation method μ ratio>

μ Ratio=(Friction coefficient at 0.025 m/s)/(Friction coefficient at 0.500 m/s).

2. The method according to claim 1, wherein in the formula (I):

a is 2, and $R^1$ is an aliphatic hydrocarbon group having 8 to 20 carbon atoms.

3. The method according to claim 1, wherein in the formula (II), $R^2$ is an aliphatic hydrocarbon group baying 8 to 2.0 carbon atoms.

4. The method according to claim 1, wherein in the formula (III), $R^3$ is an aliphatic hydrocarbon group having 8 to 20 carbon atoms.

5. The method according to claim 1, wherein in the formula (IV):

$R^4$ is an aliphatic hydrocarbon group having 12 to 18 carbon atoms, and $R^5$ and $R^6$ are each a hydrogen atom or an alkyl group having 1 to 2 carbon atoms.

6. The method according to claim 1, wherein a sum total of the amounts of the phosphorus atom derived from the components (B1) to (B3) is from 10 to 1,000 ppm by mass on the basis of the whole amount of the lubricating oil composition.

7. The method according to claim 1, wherein a sum total of the amounts of the nitrogen atom derived from the components (C1) to (C2) is from 100 to 3,000 ppm by mass on the basis of the whole amount of the lubricating oil composition.

8. The method according to claim 1, wherein the CVT is a chain-type and the lubricating oil composition is applied between a pulley and a chain of the CVT.

* * * * *